US005715786A

United States Patent [19]

Seiberth

[11] Patent Number: 5,715,786

[45] Date of Patent: Feb. 10, 1998

[54] DEVICE FOR DETECTING LEAKAGE IN A FUEL SUPPLY

[75] Inventor: Stefan Seiberth, Remseck, Germany

[73] Assignee: Robert Bosch GmbH, Stuttgart, Germany

[21] Appl. No.: 789,922

[22] Filed: Jan. 28, 1997

[30] Foreign Application Priority Data

Jun. 2, 1995 [DE] Germany ..... 195 20 300.3

[51] Int. Cl.[6] ..... F02B 77/00

[52] U.S. Cl. ..... 123/198 D; 123/198 DB; 73/49.1; 73/119 A

[58] Field of Search ..... 123/198 D, 198 DB; 73/49.1, 119 A, 40

[56] References Cited

U.S. PATENT DOCUMENTS 4,269,061 5/1981 Hatsuno et al. ..... 73/40
5,616,837 4/1997 Leonard et al. ..... 73/119 A

FOREIGN PATENT DOCUMENTS

3126393C2 4/1982 Germany .

*Primary Examiner*—Noah P. Kamen
*Attorney, Agent, or Firm*—Michael J. Striker

[57] ABSTRACT

A device for detecting leakage in a fuel supply system of an internal combustion engine in which fuel is pumped from a fuel container under pressure by at least one pump and reaches injection valves over corresponding lines, the device has a control unit, a plurality of operating condition detecting sensors detecting operating conditions of the internal combustion engine and sending signals to the control unit, a return line with a valve formed so that excess fuel is returnable to the fuel container, the valve being connected with the control unit so that when the control unit detects a predetermined operating state of the engine from the signals of the operating condition sensors, the control unit closes the valve, and a pressure sensor, and a pressure sensor operative for measuring a fuel pressure when the valve is closed and connected to the control unit so that the pressure sensor supplies to the control unit a signal corresponding to the measured pressure, and the control unit compares the signal corresponding to the measured fuel pressure with a signal corresponding to a fuel pressure to be expected to indicate a leak when a deviation between the measured fuel pressure and the fuel pressure to be expected occurs.

15 Claims, 1 Drawing Sheet

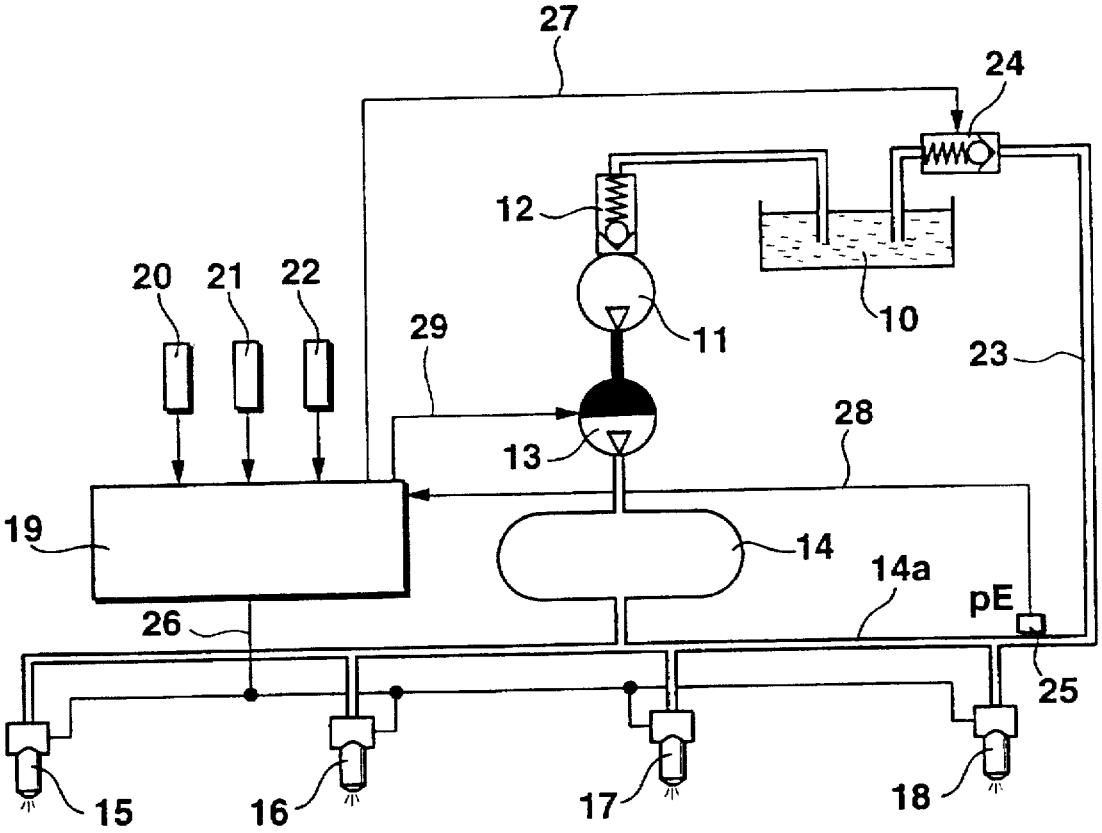
27
24
12
10
11
20
21
22
29
23
28
13
19
14
14a
pE
26
25
15
16
17
18

DEVICE FOR DETECTING LEAKAGE IN A FUEL SUPPLY

BACKGROUND OF THE INVENTION

The invention is based on a device for detecting a leak in a fuel supply system in an internal combustion engine.

In motor vehicles with an internal combustion engine the fuel is pumped out of the fuel tank by an electric fuel pump and carried via fuel lines to the injection valves. Excess fuel typically returns to the fuel tank via a return line. In engines with self-ignition, a further pump is connected to the electric fuel pump and generates a very high pressure in the region of the fuel supply that communicates with the injection valves.

In such fuel supply systems with the associated injection nozzles, there is the danger that if the valve of an injection nozzle seizes in the open position, fuel still be injected continuously into the associated combustion chamber. A leak to the outside is also possible. It has therefore been proposed for instance in German Patent DE 31 26 393 to provide means are provided which continuously measure the pressure in the high-pressure region of the fuel supply system. A drop in the pressure in the reservoir below a predetermined value leads to the detection of an error. Since in such a case fuel would be injected continuously into the engine, in the known apparatus once an error is detected the engine is shutoff or fuel pumping is terminated.

SUMMARY OF THE INVENTION

The device according to the invention having the characteristics of the main claim has the advantage over the known art that the entire high-pressure fuel supply system can be monitored for intactness. Also not only can it be detected whether an injection valve is continuously open, but a leak to the outside can also be detected. The simplicity of the device of the invention is especially advantageous.

This advantage is attained in that a pressure sensor that s pressure sensor that is present anyway in the high-pressure part of the fuel supply system, measures the fuel pressure continuously, and error detection is performed only whenever the engine control unit detects a predeterminable operating state, such as overrunning. After the detection of the overrunning, the overpressure valve disposed in the return part of the fuel supply system for regulation of, with the aid of which valve the fuel pressure, is the closed, and the resultant pressure and especially the resultant pressure change is compared with predeterminable values. An error detection is tripped if the measured pressure, or the measured pressure course, with the return valve closed does not behave as expected.

Once a leak is detected, the engine is advantageously shutoff, or the fuel supply is disrupted by turning off the high-pressure pump.

It is especially advantageous that such leak monitoring can be done whenever the control unit detects the pressure of the overrunning in that cases, no injection operations should be performed, and the injection valves remain closed. If in the process the return valve is likewise closed, then an unexpected pressure course can be caused only by a leak, which is thus unequivocally detectable. By evaluating the course over time of the pressure rise after the closure of the return valve, an especially unambiguous finding as to the presence of a leak can be made. Moreover, tolerances present in the system that are expressed as leakage are at a minimum.

BRIEF DESCRIPTION OF THE DRAWING

The sole drawing figure schematically shows the essential components of a fuel supply system for internal combustion engines with self-ignition, or in other words Diesel engines with the leak detection performed according to the invention.

DESCRIPTION OF EXEMPLARY EMBODIMENT

In the drawing, the components of a fuel supply system of an internal combustion engine with self ignition that are required for comprehension of the invention are shown. The fuel supply system has a fuel tank 10, a fuel pump 11, typically an electric fuel pump, and a check valve. The check valve 12 for instance is integrated with the fuel pump 11.

The fuel pump 11 carries the fuel to a high-pressure pump 13 connected with a high-pressure reservoir 14. From the high-pressure reservoir 14, the fuel reaches the injection nozzles 15, 16, 17, 18 disposed in a so-called common rail system 14*a*. The triggering of the injection valves 15, 16, 17, 18 is done by an electronic control unit 19 as well as suitable connections 26. Further signals that allow the operating conditions of the engine to be detected are supplied to the electronic control unit. The signals are furnished by corresponding sensors 20, 21, 22.

From the common rail 14*a*, a return conduit 23 leads back to the fuel tank 10 via a magnet valve 24. This magnet valve 24 can be triggered by the control unit 19 via the connection 27. The injection pressure in the common rail 14*a* is regulated by the magnet valve 24. The magnet valve 24 can be closed for leak detection by the control unit 19.

A pressure sensor 25 is associated with the common rail 14*a*. The pressure sensor 25 measures the fuel pressure in the common rail and carries signals accordingly to the control unit 19 via the connecting line 28.

In the fuel supply system shown in the drawing, which in principle is already known from German Patent 31 26 393, the leak detection according to the invention is performed. The requisite calculations are carried out by the control unit 19, which moreover takes on the control or regulation of the engine in a known manner. In the event that the electronic control unit 19 is an additional control unit, then an exchange of information with the engine control unit is necessary. Which evaluations or calculations will be done in which of the control units can be chosen in a suitable way.

The regulation of the pressure in the high-pressure region can also be performed by an independent pressure regulator or electronic unit. The _____ pressure regulator or electronic control unit takes the place of the electronic control unit 19 and triggers the magnet valve 14 as a function of the injection pressure pE furnished by the pressure sensor 25.

In currently used Diesel injection systems, the pump 13 producing the high pressure operates continuously at an rpm that is equivalent to about half the engine rpm. Fuel is pumped continuously, and the resultant fuel or injection pressure is regulated, as already noted, by triggering the magnet valve 24. On actuation of the injection valves, the pressure briefly drops, since a certain amount of fuel has been dispensed from the common rail. In order that such a pressure fluctuation will not be a hindrance in leak detection, the leak detection is preferably performed whenever no fuel is being injected.

Such a condition exists whenever the engine is in the overrunning mode. The leak detection is therefore carried out when the control unit of the engine, by evaluating the available information furnished for instance by the sensors 20, 21, 22, detects that the engine is in the overrunning mode. Overrunning detection by evaluating the rpm and/or other load-dependent variables is already typical in modern engines, and the precise procedure will therefore not be described in further details here. No triggerings of the injection valves are then tripped. If when overrunning is detected the magnet valve 24 is closed by the control unit, then the pressure in the common rail must rise, since the pump 13 is continuing to pump fuel. How markedly the pressure rises or within what periods of time which pressure rises are to be expected can be estimated or determined empirically from given system conditions. In the electronic control unit, comparison are therefore performed. In the comparison the pressure course pE(t) measured by the pressure sensor 25 in overrunning is evaluated or compared with predeterminable values. If the electronic control unit finds that the pressure changes or the pressure rise does not ensue as expected, then the control unit 19 trips appropriate triggerings, for instance via the connection 29. The triggering of the appropriate triggerings cause the engine to be shut off or at least terminate the fuel pumping via the high-pressure pump 13.

The detection according to the invention of a leak in the high-pressure portion of the common rail system, or of an injection valve that persists in the open position, accordingly assumes that a pressure drop in the common rail, or implausibility between the engine operating point, or in other words the relationship between the rpm and the injection quantity, and the triggering of the pressure regulating unit indicates an error, and requires corresponding countermeasures in reaction.

In general, the response of the pressure regulating circuit to set-point value changes can be monitored under certain operating conditions. Advantageously, the response can be monitored in overrunning. Plausibility exists only whenever the pressure within a time slot reaches the adjustable set-point value. If an intended change in the triggering of the pressure regulating circuit is performed, then the system response can be evaluated. From this system response it can be decided whether a leak exists.

With this system, it is accordingly possible to monitor and evaluate the dynamic behavior of the system, which leads to considerably more reliable results compared with static observation.

I claim:

1. A device for detecting leakage in a fuel supply system of an internal combustion engine, especially a self-igniting engine, in which the fuel is pumped from the fuel container under pressure by at least one pump and reaches the injection valves over corresponding lines, having a pressure sensor that measures the fuel pressure and a computation device to which other measurement variables characterizing the operating state are supplied, for forming trigger signals, characterized in that a return line with a valve is present, by way of which excess fuel can be returned to the fuel tank; that the computation device detects a predeterminable operating state of the engine from measurement variables and upon detection of this predeterminable operating state closes the valve, and the pressure or pressure course that then ensues is compared with the pressure or pressure course to be expected, and deviations indicate a leak.

2. The device for detecting a leak as defined by claim 1, characterized in that the predeterminable operating state of the engine in which the leak detection takes place is overrunning, and the detection of the overrunning mode is effected in the control unit.

3. The device for detecting a leak as defined by claim 2, characterized in that the detection of the overrunning mode is effected by evaluation of the rpm and a further variable, dependent on the load, of the throttle valve angle, each variable being ascertained by an associated sensor.

4. The device for detecting a leak as defined by claim 1, characterized in that it is monitored whether the pressure after the closure of the magnet valve varies in such a way that a predeterminable higher pressure is attained within a predeterminable time.

5. The device for detecting a leak as defined by claim 1, characterized in that the response of the pressure regulating circuit to set-point value changes is effected under certain operating conditions, and if implausible changes in the pressure occur, and in particular if the pressure does not reach the set-point value within a predeterminable time slot, a leak is detected.

6. The device for detecting a leak as defined by claim 1, characterized in that after detection of a leak, the engine or the high-pressure pump is turned off, or the delivery of fuel to the common rail is prevented.

7. A device for detecting leakage in a fuel supply system of an internal combustion engine in which fuel is pumped from a fuel container under pressure by at least one pump and reaches injection valves over corresponding lines, the device comprising a control unit; a plurality of operating condition detecting sensors detecting operating conditions of the internal combustion engine and sending signals to said control unit; a return line with a valve formed so that excess fuel is returnable to the fuel container, said valve being connected with said control unit so that when said control unit detects a predetermined operating state of the engine from the signals of said operating condition sensors, said control unit closes said valve; and a pressure sensor operative for measuring a fuel pressure when said valve is closed and connected to said control unit so that said pressure sensor supplies to said control unit a signal corresponding to the measured pressure, and said control unit compares the signal corresponding to the measured fuel pressure with a signal corresponding to a fuel pressure to be expected to indicate a leak when a deviation between the measured fuel pressure and the fuel pressure to be expected occurs.

8. A device as defined in claim 7, wherein said control unit detects the predeterminable operating state of an engine overrunning mode.

9. A device as defined in claim 8, wherein said operating condition detecting sensors include a sensor for detecting an rpm and a sensor for detecting a further variable of a throttle valve angle.

10. A device as defined in claim 7, wherein said control unit monitors whether the fuel pressure after the closure of the magnet valve varies in such a way that a predeterminable higher pressure is retained within a predeterminable time.

11. A device as defined in claim 7; and further comprising a pressure regulating circuit with a response to set-point values changing under certain operating conditions, said control unit detecting a leak when a pressure in said pressure regulating circuit does not reach the set-point value within a predeterminable time slot.

12. A device as defined in claim 7; and further comprising means for turning off the internal combustion engine after detection of the leak by said control units.

13. A device as defined in claim 7; and further comprising means for turning off the at least one pump when the leak is detected by said control unit.

14. A device as defined in claim 7; and further comprising a common rail, said pressure sensor being located in said common rail and measuring a fuel pressure in said common rail; and means for preventing a delivery of fuel to said common rail after detection of the leak by said control unit.

15. A device as defined in claim 7, wherein said control unit compares a pressure course of the measured fuel pressure with an expected pressure course.

* * * * *